US005083876A

United States Patent [19]

Mitsuishi et al.

[11] Patent Number: 5,083,876

[45] Date of Patent: Jan. 28, 1992

[54] PRINT WIRE ALIGNMENT IN A WIRE DOT PRINTER

[75] Inventors: Akio Mitsuishi; Takashi Takeuchi; Toshio Kuriyama, all of Suwa, Japan

[73] Assignee: Seiko Epson Corporation, Tokyo, Japan

[21] Appl. No.: 403,436

[22] Filed: Sep. 6, 1989

[30] Foreign Application Priority Data

Dec. 9, 1988 [JP] Japan ..... 63-311427
Dec. 9, 1988 [JP] Japan ..... 63-311428

[51] Int. Cl.[5] ..... B41J 2/26
[52] U.S. Cl. ..... 400/124; 101/93.05
[58] Field of Search ..... 400/124; 101/93.05

[56] References Cited

U.S. PATENT DOCUMENTS

| | | | |
|---|---|---|---|
| 4,218,150 | 8/1980 | Swaim | 400/124 |
| 4,225,250 | 9/1980 | Wagner et al. | 400/124 |
| 4,437,775 | 3/1984 | Ochiai et al. | 400/124 |
| 4,453,840 | 6/1984 | Hodne | 400/124 |
| 4,473,311 | 9/1984 | Sakaida | 400/124 |
| 4,571,102 | 2/1986 | Ono et al. | 400/248 |
| 4,669,898 | 6/1987 | Yeh et al. | 400/124 |

FOREIGN PATENT DOCUMENTS

| | | | |
|---|---|---|---|
| 2388677 | 11/1978 | France | 400/124 |
| 58-29681 | 2/1983 | Japan | 400/124 |
| 91070 | 5/1984 | Japan | 400/124 |
| 5954 | 1/1986 | Japan | 400/124 |

*Primary Examiner*—David A. Wiecking
*Attorney, Agent, or Firm*—Blum Kaplan

[57] ABSTRACT

A printing head for a wire dot printer includes a plurality of printing levers connected to a corresponding plurality of printing wires. A plurality of guide holes are operable for guiding the distal ends of the printing wires beyond a nose of the printing head. Each guide hole corresponds to one of the plurality of printing levers. As viewed from the nose of the printing head, each printing lever extends radially from its corresponding guide hole and the inner ends of the printing levers form a zig-zag pattern. A plurality of plate springs provides the resilient force to push the printing levers and thereby the printing wires toward the nose of the printing head. A spacer for supporting the plate springs equalizes the effective length of each plate spring.

38 Claims, 5 Drawing Sheets

PRINT WIRE ALIGNMENT IN A WIRE DOT PRINTER

BACKGROUND OF THE INVENTION

This invention relates generally to a wire dot printer, and more particularly, to a printing head for use with a wire dot printer.

Enhancements are constantly sought in printing quality and processing speed of wire dot printers especially since wire dot printers are commonly used with computer terminal equipment for forming character patterns or the like on a recording medium. Conventional printing heads are disclosed in U.S. Pat. No. 4,669,898 and Japanese Patent Laid-Open Publication No. 29681/1983.

As shown in FIG. 5, a conventional printing head 100 includes a plurality of printing levers and a corresponding plurality of guide holes 108. Printing levers a are radially disposed and directed toward a projection of guide holes 108, which are arrayed in two lines at a nose top end of printing head 100. The inner ends of printing levers a are aligned so as to form an elliptical path 112. A corresponding plurality of printing wires b extend on an incline from the inner ends of printing levers a (hereinafter referred to as joining points c). Each printing wire b has a printing terminal end at a guide hole 108. A projected distance l between joining point c and printing terminal end d of each printing wire b is reduced in length as much as possible. Deflections of printing wire b are thereby minimized, resulting in a reduction in friction between printing wires b and the walls of guide holes 108. Furthermore, by reducing the length of printing wires b as much as possible the inertia of each printing wire b decreases resulting in an increase in printing process speed.

When the inner ends of printing levers a are concentrated at the center of printing head 100 so as to form elliptical path 112, adjacent printing wires b are disposed in such close proximity to one another that they may contact each other, especially in the end regions exemplified by a circle 114. More particularly, the inner ends of printing levers a along the region defined by the relatively large elliptical curve 112 are in such close proximity to one another that a sufficient number of printing wires b to provide a high level of printing quality is impossible.

To avoid printing wires b from contacting each other, tolerances associated with the processing and assembling of parts forming printing head 100 are quite small, that is, there must be a significant increase in the accuracy of processing and assembling the parts forming printing head 100. Production costs associated with printing head 100 undesirably and unnecessarily can significantly increase.

Accordingly, it is desirable to provide a printing head for a wire dot printer which produces printed matter of high quality. An increase in printing speed without increasing the need for producing and assembling the parts of the printing head more accurately is also desirable.

SUMMARY OF THE INVENTION

Generally speaking, in accordance with the invention, a printing head for a wire dot printer includes a plurality of printing levers, each printing lever having an inner end. The printing head also includes a plurality of printing wires, each printing wire extending between a distal end and a proximal end and connected at its proximal end to the inner end of a corresponding printing lever. The printing head includes a nose and a plurality of guide holes for guiding the distal ends of the printing wires beyond the nose of the printing head. Each guide hole corresponds to one of the printing levers.

Each printing lever extends essentially radially from a projection of its corresponding guide hole and the inner ends of the printing levers at the junction with the associated printing wire form a zig-zag pattern as viewed from the nose. One of a plurality of plate springs of the print head is fixed to each of the plurality of printing levers. The plate springs apply a resilient force to the printing levers for pushing the distal end of the printing wires beyond the nose of the printing head.

The printing head also includes a spacer for supporting the plate springs and for equalizing the effective length of each printing lever combined with its associated plate spring. The spacer has an inner peripheral edge with an uneven contour. The effective length of each printing lever combined with its associated plate spring includes the length of the printing lever and the length of the associated plate spring from the end connected to the printing lever to the inner peripheral edge of the spacer.

In accordance with another aspect of the invention, a printing head for a wire dot printer includes a plurality of printing levers, each printing lever having an inner end and an axial direction. Each of a plurality of printing wires extends between a distal end and a proximal end and is connected at its proximal end to the inner end of a corresponding printing lever. The printing head includes a nose and at least one group of guide holes operable for guiding the distal ends of the printing wires beyond the nose of the printing head.

Each guide hole has a center through which the distal end of the printing wire can be projected. The axial direction of a printing lever associated with a guide hole positioned at an end of the group of guide holes does not pass through the projection of the center of the associated guide hole as viewed from the nose. Accordingly, there is an angular deviation between the end printing lever and printing wire connected thereto. Such angular deviation is provided between the printing lever and printing wire at each end of a line of guide holes.

The printing levers are spaced from one another to form a gap therebetween. Therefore, the printing wires avoid contact with each other.

Accordingly, it is an object of this invention to provide an improved printing head for a wire dot printer which is operable for producing printed matter of high quality.

Another object of the invention is to provide an improved printing head for a wire dot printer which increases the printing speed compared with conventional printing heads for wire dot printers.

A further object of the invention is to provide an improved printing head for a wire dot printer which does not require that the parts of the printing head be produced and assembled more accurately in order to increase the printing speed.

It is still a further object of the invention to provide an improved printing head for a wire dot printer which has a high concentration of printing wires which do not come into contact with each other during operation of the printing head.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 6:
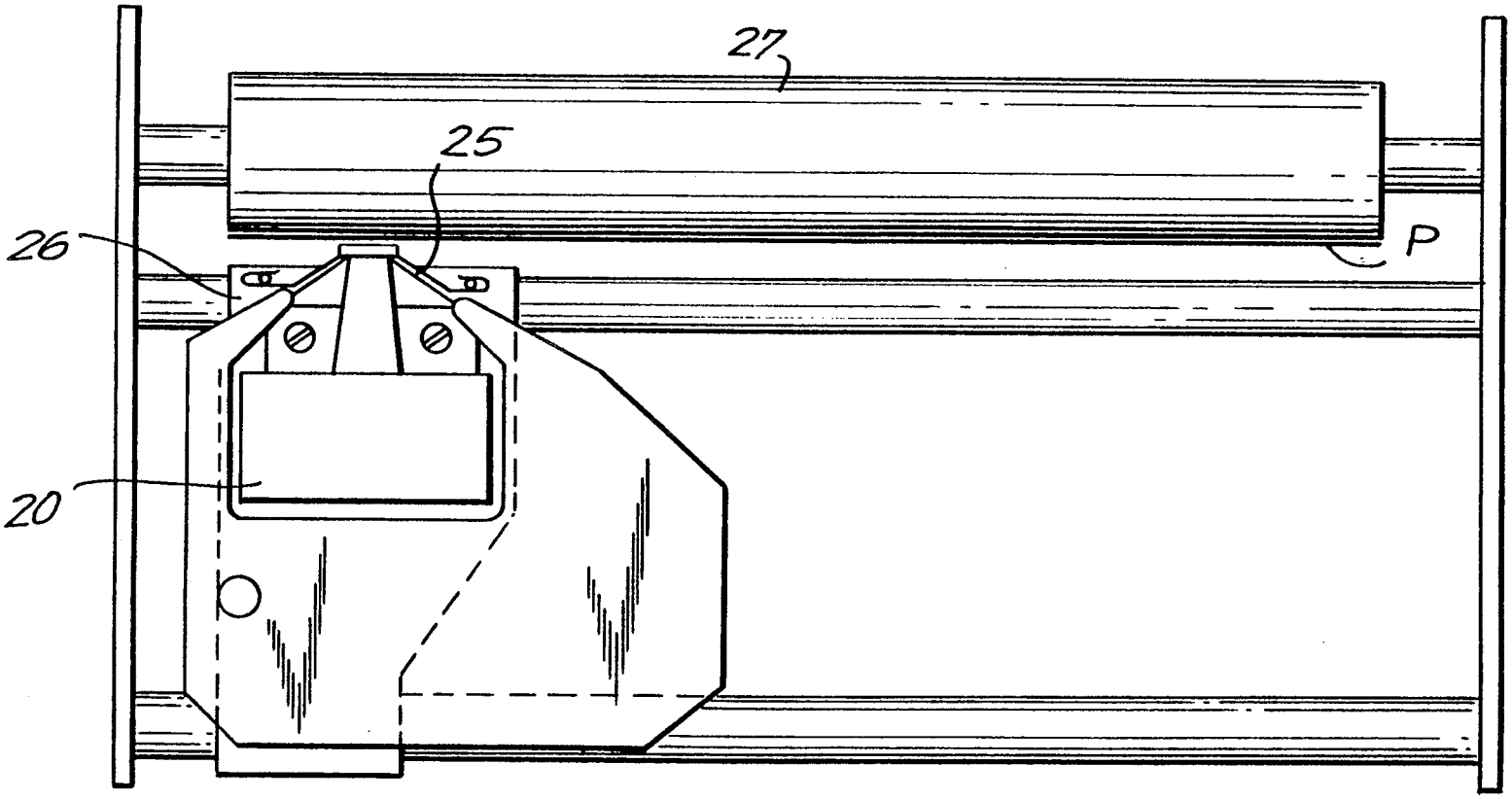
FIG. 6 is a top plan view of a wire dot printer in accordance with the invention.

Referring initially to FIG. 6, a wire dot printer in accordance with the invention is schematically illustrated. Desired figures and characters are printed on printing paper P arranged between platen 27 and ink ribbon 25 by impact dot head 20 mounted on carriage 26 movably supported in the printing direction.

Figure 3:
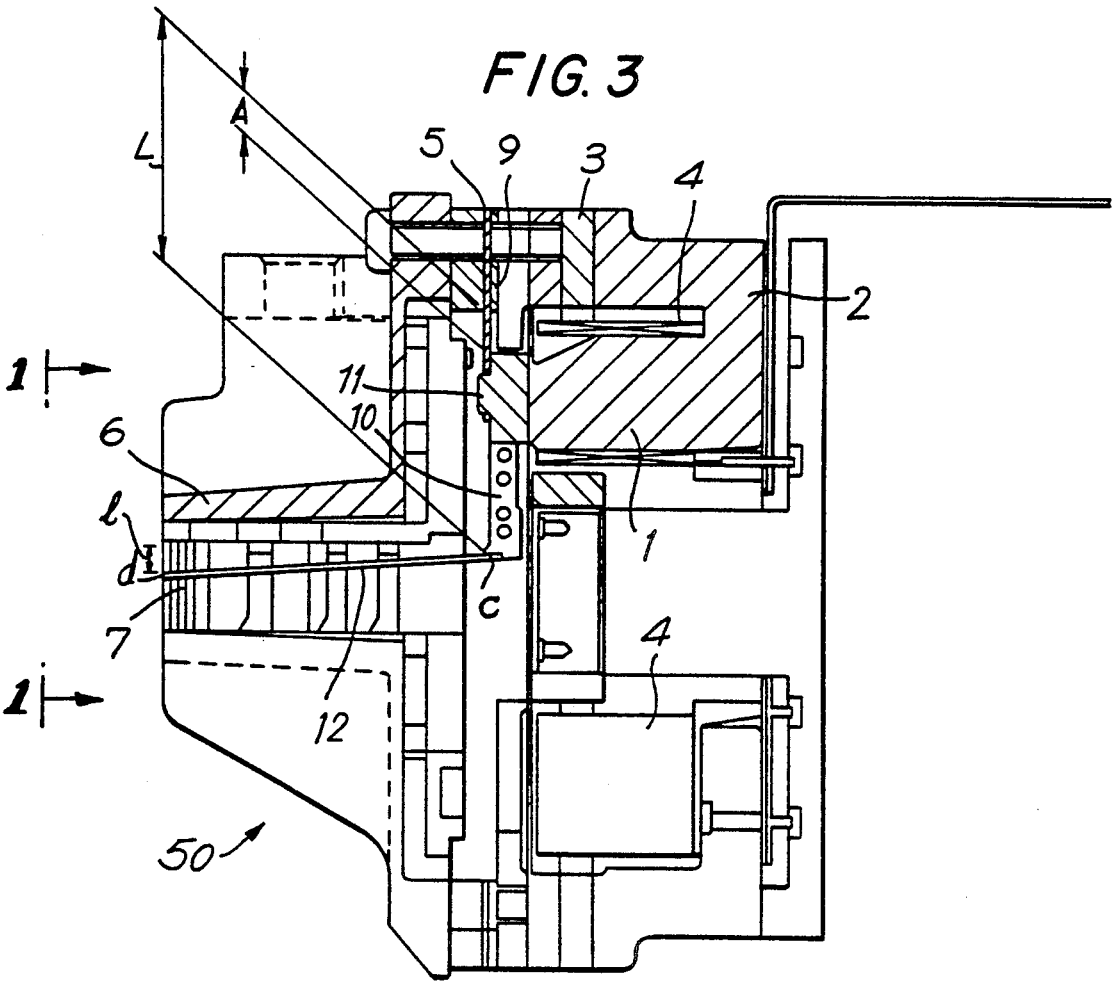
FIG. 3 is a sectional view of the printing head of FIG. 1.

As shown in FIG. 3, a printing head 50 includes a plurality of cores 1 which protrude from the surface of an annular magnetic plate 2. Positioned on the end surface of each core 1 is a plunger 11. A plurality of printing levers 10 are fixed to a corresponding plurality of plungers 11. Printing head 50 also includes a nose 6. The magnetic fluxes produced by a permanent magnet 3 which is secured to the surface of magnetic plate 2 attract corresponding plungers 11 and thereby oppose the resilient forces of a plurality of plate springs 5. Printing levers 10 are also connected to plate spring 5 through plungers 11.

During non-printing, the magnetic circuit formed by permanent magnets 3, magnetic plate 2, cores 1 and plunger 11 holds plunger 11 in place. Plate springs 5 are unable to move printing levers 10 toward nose 6. During printing, however, the attractive force holding one or more plungers 11 in place is offset (i.e. cancelled) by the magnetic fluxes produced by a plurality of electromagnetic coils 4 each wound on a core 1. More particularly, the magnetic fluxes from a selected number of electromagnetic coils 4 serve to offset the magnetic fluxes produced by permanent magnets 3 so that the resilient forces of plate springs 5 move printing levers 10 toward nose 6. A plurality of printing wires 12 are each connected to the inner ends of printing levers 10. Movement of printing levers 10 toward nose 6 results in printing wires 12 protruding beyond the top end of nose 6 to effect printing.

Figure 4:
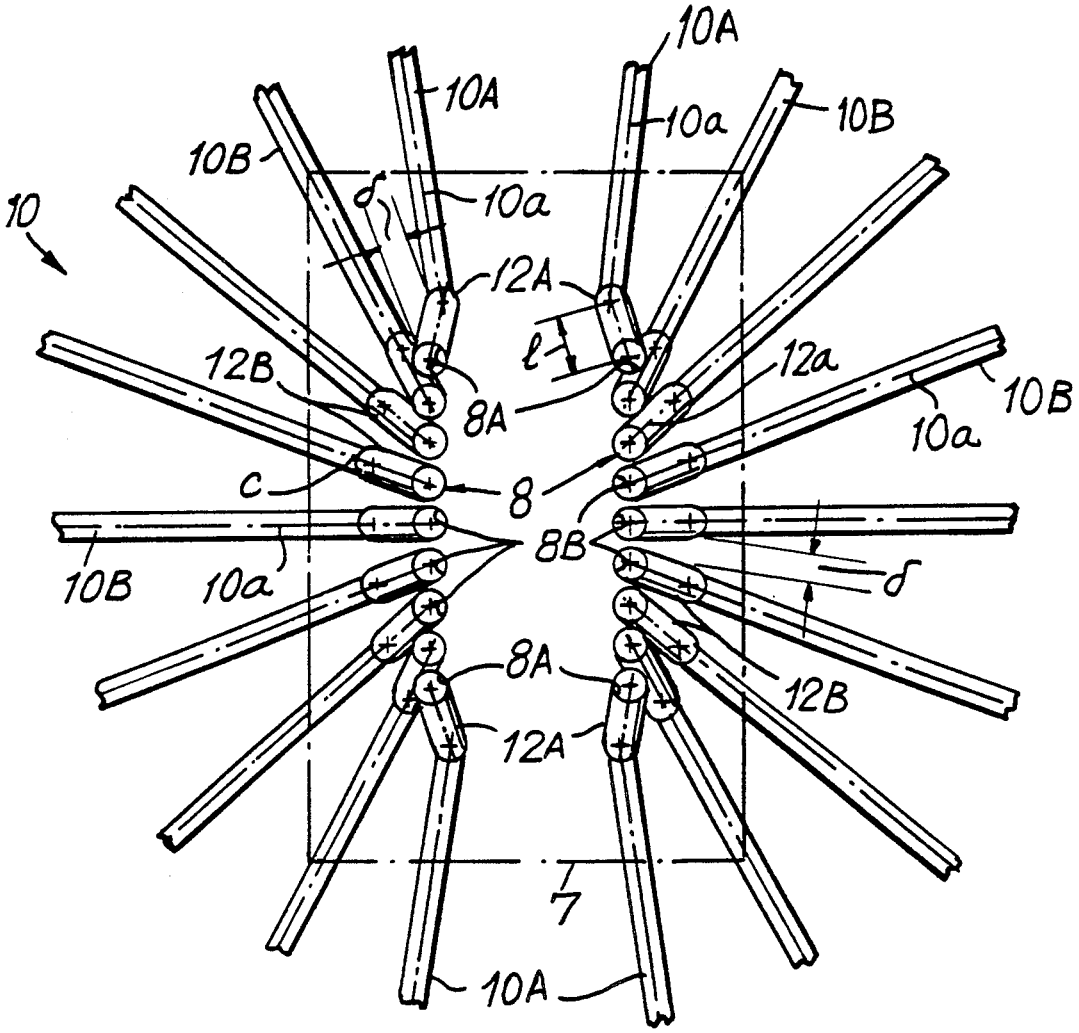
FIG. 4 diagrammatically illustrates a printing head in accordance with an alternative embodiment of the invention.
Figure 5:
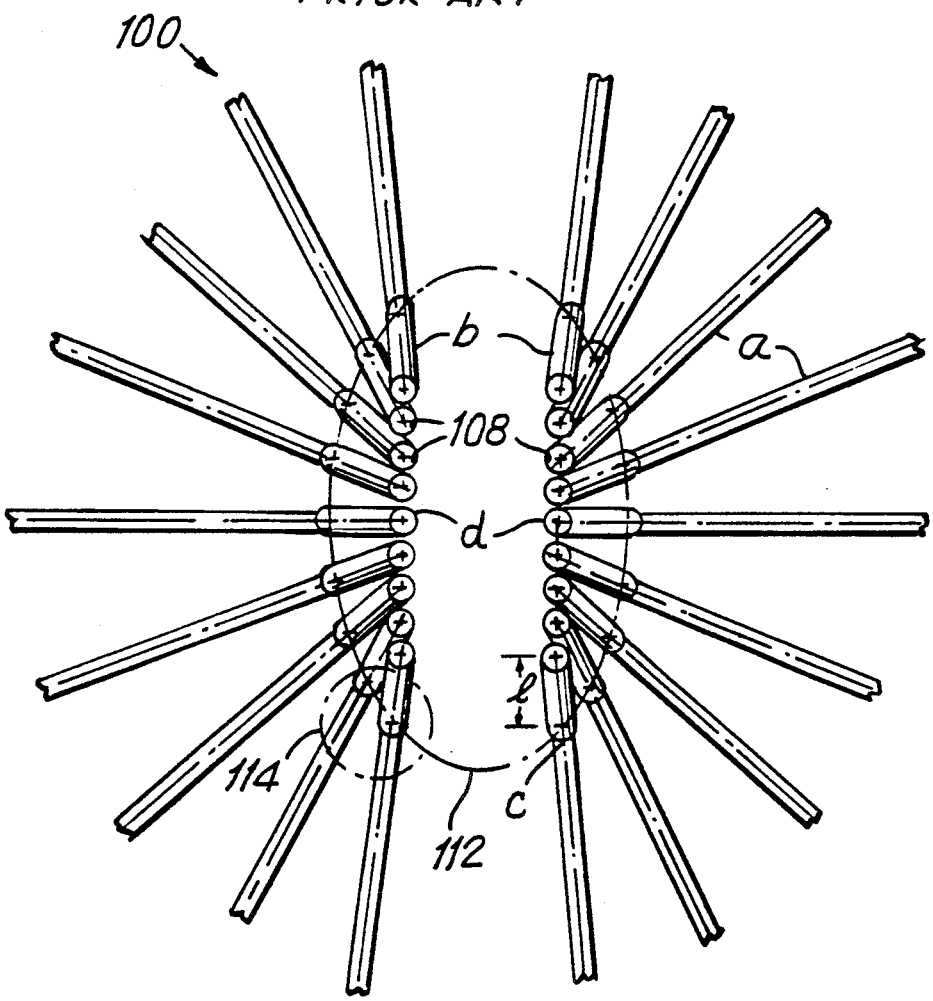
FIG. 5 PRIOR ART
FIG. 5 diagrammatically illustrates a printing head in accordance with the prior art.

In accordance with one embodiment of the invention, FIG. 4 shows the positional relationship between printing levers 10 and printing wires 12 with dimensions thereof enlarged for illustrative purposes. A guide plate 7 is fixed to a top end of nose 6 and is perforated with a plurality of guide holes 8 which are arranged along two substantially straight lines. Guide holes 8, which include four guide holes 8A at the ends of each line and a plurality of interior guide holes 8B, serve to guide the printing (distal) ends of printing wires 12 which are fixed at their proximal ends to the inner ends of printing levers 10. Each line of guide holes 8 begins and end with guide hole 8A. Positioned between guide holes 8A in each line are guide holes 8B. Associated with each guide hole 8A and each guide hole 8B are printing wires 12A and 12B, respectively, having printing ends which are pushed through guide holes 8A and 8B by printing levers 10A and 10B, respectively. Printing levers 10B are in very close proximity to (i.e. concentrated) and face one another and are further positioned so as to appear to be extending radially from the projection of the centers of their associated guide holes 8B. Accordingly, each axial line 10*a* of each printing lever 10B is aligned with the projected centers of corresponding guide holes 8B.

The inner ends of printing levers 10A and 10B extend outwardly from their associated guide holes 8A and 8B by a distance l, respectively. Adjacent printing levers (e.g. 10B, 10B or 10B, 10A) are separated from each other at their joining points c by spacings Γ (e.g. 0.2 mm). Consequently, the inner ends of printing levers 10A and 10B do not come into contact with one another.

Printing levers 10A corresponding to guide holes 8A are arranged such that the projection of axis 12*a* of each printing wire 12A, in the plane of printing levers 10A, is inclined to define an obtuse angle with its corresponding axial line 12*a* when facing an adjacent printing lever 10B. Printing levers 10A are also separated by at least a spacing δ from adjacent printing levers 10B. The inwardly direction of axial lines 10*a* of printing levers 10A is accommodated due to the distance separating the two lines of guide holes 8.

Under the foregoing construction, angular deviations exist between axial lines 10*a* of printing levers 10A and projected axial lines 12*a* of printing wires 12 which are fixed to the inner ends of printing levers 10A at joining points c.

In accordance with this first embodiment of the invention, only axial directions 10*a* of printing levers 10A deviate from (i.e. not in alignment with) the projected centers of their corresponding guide holes 8A to form the necessary spacings δ (i.e. gaps) between adjacent printing levers 10B and 10A. Furthermore, when a high density of printing levers 10 are desired which would otherwise require considerable processing and/or assembling accuracy to obtain the necessary spacings δ between adjacent printing levers, angular deviations between some or all printing levers 10B and their corresponding printing wires 12 can be employed to accommodate the unusually high density of printing lever 10.

Figure 1:
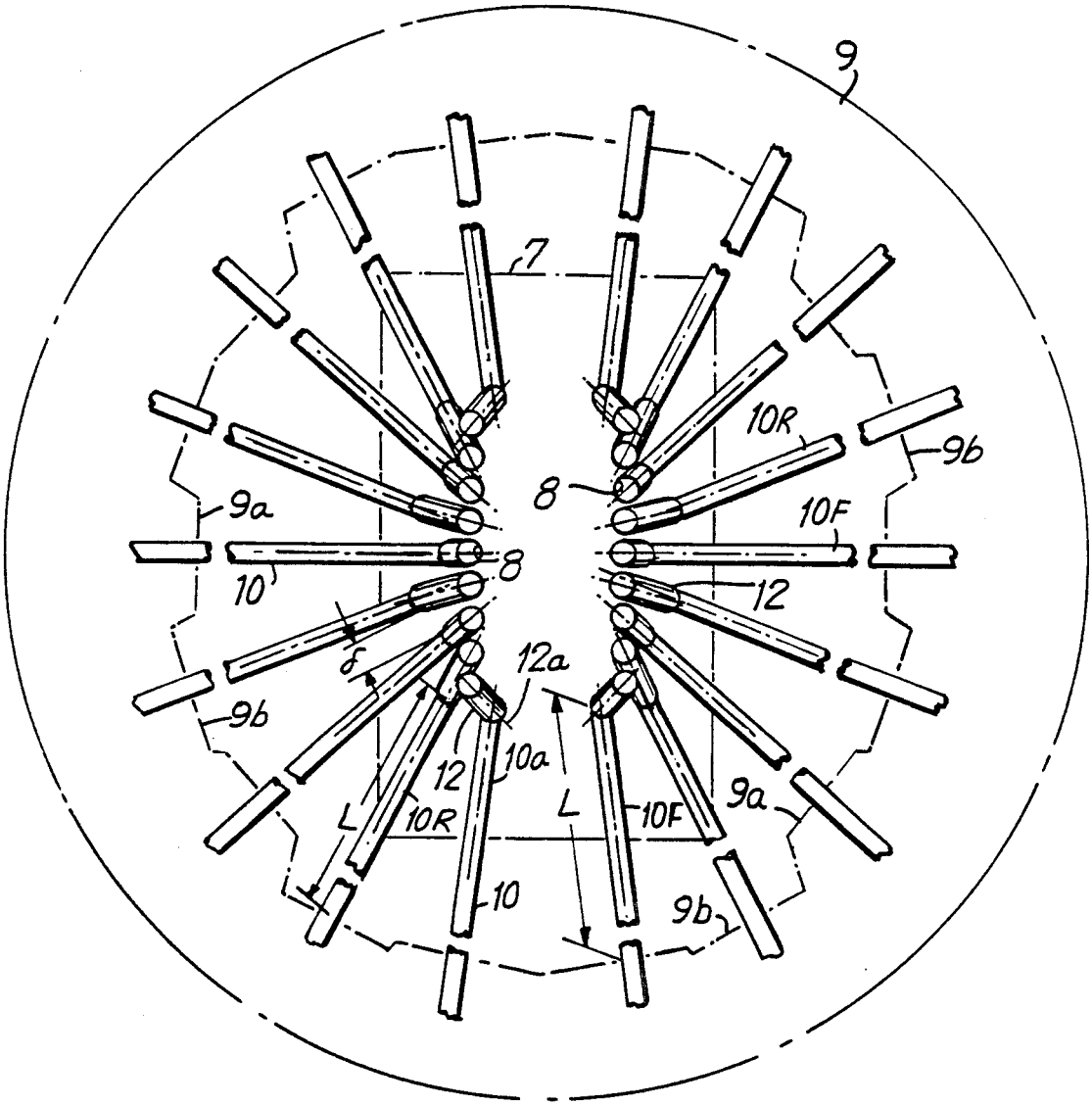
FIG. 1 diagrammatically illustrates a printing head in accordance with one embodiment of the invention as viewed along lines 1—1 of FIG. 3.
Figure 2:
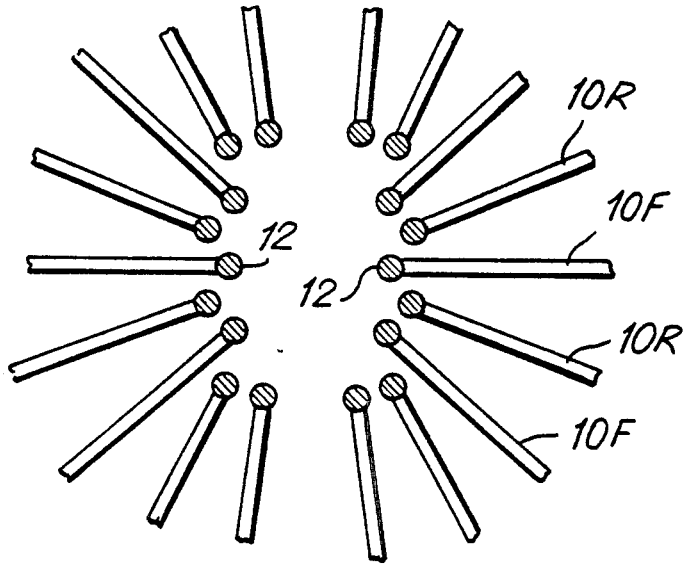
FIG. 2 diagrammatically illustrates an array of printing levers of FIG. 1.

FIGS. 1, 2 and 3 illustrate a second embodiment of the invention. A group of printing levers 10 are separated from each other at spacings δ of, or example, 0.2 mm. The plurality of printing levers 10 correspond to the plurality of cores 1 provided on angular magnetic plate 2. During the printing operation spacings δ between the tops of printing levers 10 ensure that printing levers 10 are not brought into contact with one another. Printing levers 10 are disposed in close proximity to one another (i.e. concentrated) near a d just above guide plate 7.

As shown in FIG. 2, printing levers 10 include alternating printing levers 10R and 10F. Each printing lever 10R and 10F has an inner end to which a corresponding printing wire 12 is fixed. The inner ends of printing levers 10F and 10R are arranged in a zig-zag manner as shown in FIG. 2. More particularly, the inner ends of printing levers 10F protrude more inwardly i.e. more forwardly) toward the center of guide plate 7. The top ends of printing levers 10F are therefore as close as possible to being positioned just above their corresponding guide holes 8 (i.e. distance l approaches a value of 0). The top ends of printing levers 10R are disposed behind the top ends of printing levers 10F and further away from the center of guide plates 7. Nevertheless, the top ends of printing levers 10R are positioned as close as possible to being just above their corresponding guide holes 8.

Referring once again to FIGS. 1 and 3, an inner peripheral edge 9*a* of a spacer 9 for supporting corresponding plate springs 5 is sloped to define an uneven contour. The position of the peripheral edge 9*a* of pacer 9 at end plate spring 5 equalizes the effective length L of each printing lever 10 and its corresponding plate spring 5 by maintaining an effective length A of each plate spring 5 which exerts a resilient force against printing lever 10. More particularly, the distance (i.e. effective length L) from the inner end of printing lever 10F through that portion of plate spring 5 which is held in place by spacer 9 (i.e. effective length A of plate spring 5) is the same as the distance (effective length L) from the inner end of printing lever 10R through that portion of plate spring 5 which is held in place by a spring support part 9*b* (i.e. effective length A of plate spring 5). The printing levers 10R and 10F are all essentially dimensionally the same, as are the plungers 11, so that the effective length A of the plate springs 5 are essentially identical.

Plungers 11 and plate springs 5 are omitted from FIG. 1 to more clearly illustrate the relationship between spring support parts 9*a* and 9*b* and printing levers 10F and 10R. The fundamental construction including dimensions, etc. of plungers 11 and printing levers 10F and 10R are the same as discussed heretofore. Accordingly, as shown in FIG. 3, the effective lengths L and A are the same.

Since the inner ends of printing levers 10F are positioned as close as possible to being just above corresponding guide holes 8, the angular deviation between printing levers 10F and their corresponding printing wires 12 is substantially zero (i.e. the deflections of printing wires 12 are substantially eliminated). The top ends of printing levers 10R, which are positioned rearwardly from the top ends of printing levers 10F, are also as close as possible to their corresponding guide holes 8 without coming into contact with printing levers 10F.

Preferably, the inner ends of printing levers 10R are positioned within about 0. 5 mm of their corresponding guide holes 8. Deflection of printing wires 12 associated with printing levers 10R are minimized. Axial lines 10*a* of some printing levers 10 including the end levers of each line, may deviate from the projected centers of corresponding guide holes 8, such that the projection of axes 12*a* of printing wires 12 and axial lines 10*a* of printing levers 10 are not in alignment with each other end define the obtuse angles described in connection with printing levers 10A of FIG. 4. The deviations in alignment between axial lines 10*a* and projected axes 12*a*, however, is remarkably small as compared to effective lengths L. Consequently, these deviations in alignment between printing axes 12*a* and axial lines 10*a* have little if any impact on the operation of the printing head.

The plurality of printing levers 10 disposed in a zigzag pattern creates an outwardly fan-shaped pattern of printing levers 10 radially disposed about the center of their corresponding guide holes as shown in FIG. 2. Advantageously, the spacing between adjacent printing levers at their inner ends permits a high density (concentration) of printing wires 12 to be positioned about and at the center of printing head 50 without requiring a significant increase in accuracy when processing and assembling the parts of printing head 50.

Since the top ends of printing levers 10F extend toward and just above their corresponding guide holes 8 and since the top ends of printing levers 10R are also sufficiently proximate to be substantially just above their corresponding guide holes 8, the deflections of printing wires 12 associated with printing levers 10F and 10R are significantly reduced to the greatest degree possible. A decrease in the friction between printing wires 12 and the wire guide members (e.g. guide holes 8) results. Consequently, the durability of printing head 50 is increased. Furthermore, the total length of printing wires 12 can be decreased to ensure that the deflection (i.e. angular deviation) of printing wires 12 is within permissible limits. By decreasing the length of printing wires 12, the inertia of printing wires 12 is decreased resulting in an increase in printing process speed. In particular, a high speed printing process requiring smaller driving forces is attained by the invention.

As now can be readily appreciated, the positioning of printing levers 10A so as to deviate from (i.e. not be in alignment with) guide holes 8A permits the necessary spacings (gaps) between adjacent printing levers 10 to be achieved. These gaps permit a high concentration of printing wires 12 to be used without printing wires 12 coming into contact with each other just above guide holes 8. Furthermore, these gaps permit printing levers 10 to be arranged in very close proximity to one another without requiring a significant enhancement in accuracy in processing and assembling the parts of printing head 50.

The deflections of printing wires 12 are minimized thereby reducing the friction between printing wires 12 and the wire guide members. An increase in durability of printing head 50 is achieved. Additionally, the printing speed can be increased by decreasing the overall length of printing wires 12. The greater the decrease in overall length of printing wires 12, the greater the increase in printing speed.

It will thus be seen that the objects set forth above, and those made apparent from the preceding description, are efficiently attained and, since certain changes may be made in the above construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which, as a matter of language, may be said to fall therebetween.

What is claimed is:

1. A wire dot printer having a printing head, said printing head having a nose and further comprising:

a plurality of printing levers, each printing lever having an inner end;

a plurality of printing wires, each printing wire extending between a distal end and a proximal end and connected at its proximal end to the inner end of a corresponding printing lever;

guide means operable for guiding the distal ends of printing wires beyond the nose of the printing head and including a plurality of guide holes, each guide hole corresponding to one of the plurality of printing levers and having a center through which the distal end of the associated printing wire can be projected; and a plurality of plate springs, each plate spring fixed at one end and for applying a resilient force to one of the plurality of printing levers, and spacing means for supporting said plate springs and for essentially equalizing the effective length of each plate spring;

wherein each printing lever extends radially from a projection of its corresponding guide hole in the plane of the printing lever, the inner ends of the printing levers form a zig-zag pattern as viewed from the nose, and the axial direction of at least one printing lever associated with a guide hole at an end of the plurality of guide holes not passing through the center projection of said associated guide hole in the plane of the printing levers as viewed from the nose; and wherein the spacing means has an inner peripheral edge, the effective length of each plate spring equals the length of the plate spring from the end connected to its associated printing lever to the inner peripheral edge of the spacing means and the axial direction of each printing lever associated with a guide hole other than at each end of the plurality of guide holes extends through the projection of the center of its associated guide hole as viewed from the nose.

2. The printing head of claim 1, wherein each printing wire has an axial direction and the axial direction of said at least one printing lever and the axial direction of the associated printing wire form an obtuse angle in a plane formed by said at least one printing lever and associated printing wire.

3. A wire dot printer having a printing head, said printing head having a nose and further comprising:

a plurality of printing levers, each printing lever having an inner end;

a plurality of printing wires, each printing wire extending between a distal end and a proximal end and connected at its proximal end to the inner end of a corresponding printing lever; and guide means operable for guiding the distal ends of printing wires beyond the nose of the printing head and including a plurality of guide holes, each guide hole corresponding to one of the plurality of printing levers and having a center through which the distal end of the associated printing wire can be projected;

each printing lever extending radially from a projection of its corresponding guide hole in the plane of the printing lever, the inner ends of the printing levers forming a zig-zag pattern as viewed from the nose, and the axial direction of at least one printing lever associated with a guide hole at an end of the plurality of guide holes not passing through the center projection of said associated guide hole in the plane of the printing levers as viewed from the nose; and wherein the axial direction of each printing lever associated with a guide hole other than at each end of the plurality of guide holes extends through the projection of the center of its associated guide hole as viewed from the nose.

4. The printing head of claim 3, wherein each printing wire has an axial direction and the axial direction of said at least one printing lever and the axial direction of the associated printing wire form an obtuse angle in a plane formed by said at least one printing lever and associated printing wire.

5. A wire dot printer having a printing head, said printing head having a nose and further comprising:

a plurality of printing levers, each printing lever having an inner end and an axial direction;

a plurality of printing wires, each printing wire extending between a distal end and a proximal end and connected at its proximal end to the inner end of a corresponding printing lever; and guide means operable for guiding the distal ends of the printing wires beyond the nose of the printing head and including at least one group of guide holes, each guide hole having a center through which the distal end of the printing wire can be projected;

the axial direction of at least one printing lever associated with a guide hole positioned at an end of the at least one group of guide holes not passing through the center projection of said associated guide hole in the plane of the printing levers as viewed from the nose;

wherein the axial direction of each printing lever associated with a guide hole other than at each end of the group of guide holes extends through the projection of the center of its associated guide hole as viewed from the nose.

6. The printing head of claim 4, wherein said printing levers are spaced from one another to form gaps therebetween whereby said printing wires avoid contact with each other.

7. A wire dot printer having a printing head, said printing head having a nose and further comprising:

a plurality of printing levers, each printing lever having an inner end;

a plurality of printing wires, each printing wire extending between a distal end and a proximal end and connected at its proximal end to the inner end of a corresponding printing lever; and guide means operable for guiding the distal ends of printing wires beyond the nose of the printing head and including a plurality of guide holes arranged into at least two groups of guide holes, said groups forming parallel planes;

wherein each guide hole corresponds to one of the plurality of printing levers, each printing lever extends radially from a projection of its corresponding guide hole in the plane of the printing levers and the inner ends of the printing levers corresponding to the guide holes in one of the at least two groups of parallel planes form a zig-zag pattern as viewed from the nose.

8. The printing head of claim 7, wherein each of the printing wires extends in substantially the same direction.

9. The printing head of claim 7, further including a plurality of plate springs, each plate spring fixed at one end and for applying a resilient force to one of the plurality of printing levers, and spacing means for supporting said plate springs and for essentially equalizing the effective length of each plate spring.

10. The printing head of claim 9, wherein each of the printing wires extends in substantially the same direction.

11. The printing head of claim 9, wherein the spacing means has an inner peripheral edge and wherein the effective length of each plate spring equals the length of the plate spring from the end connected to its associated printing lever to the inner peripheral edge of the spacing means.

12. The printing head of claim 11, wherein each of the printing wires extends in substantially the same direction.

13. The printing head of claim 11, wherein the inner peripheral edge of the spacing means has an uneven contour.

14. The printing head of claim 13, wherein each of the printing wires extends in substantially the same direction.

15. A wire dot printer having a printing head, said printing head having a nose and further comprising:

a plurality of printing levers, each printing lever having an inner end and an axial direction;

a plurality of printing wires, each printing wire extending between a distal end and a proximal end and connected at its proximal end to the inner end of a corresponding printing lever; and guide means operable for guiding the distal ends of the printing wires beyond the nose of the printing head and including at least two groups of guide holes arranged in parallel planes, each guide hole having a center through which the distal end of the printing wire can be projected;

the inner ends of the printing levers corresponding to the guide holes in one of the at least two groups of parallel planes forming a zig-zag pattern as viewed from the nose; and the axial direction of at least one printing lever associated with a guide hole at an end of a first of the at least two groups of guide holes not passing through the center projection of said associated guide hole in the plane of the printing levers and being substantially parallel to the axial direction of at least one printing lever associated with a guide hole positioned at an end of a second of the at least two groups of guide holes as viewed from the nose.

16. The printing head of claim 15, wherein each printing wire has an axial direction, the axial direction of said at least one printing lever and the axial direction of the associated printing wire forming an obtuse angle in the plane formed by said at least one printing lever and associated printing wire.

17. The printing head of claim 15, wherein said printing levers are spaced from one another to form gaps therebetween whereby said printing wires avoid contact with each other.

18. The printing head of claim 17, wherein each printing wire has an axial direction and the axial direction of said at least one printing lever and the axial direction of the associated printing wire form an obtuse angle in a plane formed by said at least one printing lever and associated printing wire.

19. The printing head of claim 15, wherein the axial direction of at least one printing lever associated with a guide hole other than at each end of the at least one group of guide holes does not extend through the projection of the center of its associated guide hole.

20. The printing head of claim 19, wherein each printing wire has an axial direction and the axial direction of said at least one printing lever and the axial direction of the associated printing wire form an obtuse angle in a plane formed by said at least one printing lever and associated printing wire.

21. The printing head of claim 19, wherein said printing levers are spaced from one another to form gaps therebetween whereby said printing wires avoid contact with each other.

22. The printing head of claim 21, wherein each printing wire has an axial direction and the axial direction of said at least one printing lever and the axial direction of the associated printing wire form an obtuse angle in a plane formed by said at least one printing lever and associated printing wire.

23. The printing head of claim 15, wherein the axial direction of each printing lever associated with a guide hole other than at each end of the at least one group of guide holes extends through the projection of the center of its associated guide hole as viewed from the nose.

24. The printing head of claim 23, wherein each printing wire has an axial direction and the axial direction of said at least one printing lever and the axial direction of the associated printing wire form an obtuse angle in a plane formed by said at least one printing lever and associated printing wire.

25. The printing head of claim 23, wherein said printing levers are spaced from one another to form gaps therebetween whereby said printing wires avoid contact with each other.

26. The printing head of claim 25, wherein each printing wire has an axial direction and the axial direction of said at least one printing lever and the axial direction of the associated printing wire form an obtuse angle in a plane formed by said at least one printing lever and associated printing wire.

27. A wire dot printer having a printing head, said printing head having a nose and further comprising:

a plurality of printing levers, each printing lever having an inner end;

a plurality of printing wires, each printing wire extending between a distal end and a proximal end and connected at its proximal end to the inner end of a corresponding printing lever; and guide means operable for guiding the distal ends of printing wires beyond the nose of the printing head and including a plurality of guide holes arranged in at least two groups forming planes parallel to each other, each guide hole corresponding to one of the plurality of printing levers and having a center through which the distal end of the associated printing wire can be projected;

each printing lever extending radially from a projection of its corresponding guide hole in the plane of the printing lever, the inner ends of the printing levers corresponding to the guide holes in one of the at least two groups of parallel planes forming a zig-zag pattern as viewed from the nose, and the axial direction of at least one printing lever associated with a guide hole at an end of a first of the at least two groups of guide holes not passing through the center projection of said associated guide hole in the plane of the printing levers and being substantially parallel to the axial direction of at least one printing lever associated with a guide hole positioned at an end of a second of the at least two groups of guide holes as viewed from the nose.

28. The printing head of claim 27, wherein said printing levers are spaced from one another to form gaps therebetween whereby said printing wires avoid contact with each other.

29. The printing head of claim 27, wherein each printing wire has an axial direction and the axial direction of said at least one printing lever and the axial direction of the associated printing wire form an obtuse angle in a plane formed by said at least one printing lever and associated printing wire.

30. The printing head of claim 27, wherein the axial direction of each printing lever associated with a guide hole other than at each end of the plurality of guide holes extends through the projection of the center of its associated guide hole as viewed from the nose.

31. The printing head of claim 30, wherein each printing wire has an axial direction and the axial direction of said at least one printing lever and the axial direction of the associated printing wire form an obtuse angle in a plane formed by said at least one printing lever and associated printing wire.

32. The printing head of claim 27, further including a plurality of plate springs, each plate spring fixed at one end and for applying a resilient force to one of the plurality of printing levers, and spacing means for supporting said plate springs and for essentially equalizing the effective length of each plate spring.

33. The printing head of claim 32, wherein said printing levers are spaced from one another to form gaps therebetween whereby said printing wires avoid contact with each other.

34. The printing head of claim 32, wherein each printing wire has an axial direction and the axial direction of said at least one printing lever and the axial direction of the associated printing wire form an obtuse angle in a plane formed by said at least one printing lever and associated printing wire.

35. The printing head of claim 32, wherein the spacing means has an inner peripheral edge and wherein the effective length of each plate spring equals the length of the plate spring from the end connected to its associated printing lever to the inner peripheral edge of the spacing means.

36. The printing head of claim 35, wherein the axial direction of each printing lever associated with a guide hole other than at each end of the plurality of guide holes extends through the projection of the center of its associated guide hole as viewed from the nose.

37. The printing head of claim 36, wherein said printing levers are spaced from one another to form gaps therebetween whereby said printing wires avoid contact with each other.

38. The printing head of claim 36, wherein each printing wire has an axial direction and the axial direction of said at least one printing lever and the axial direction of the associated printing wire form an obtuse angle in a plane formed by said at least one printing lever and associated printing wire.

* * * * *